US010446003B2

(12) United States Patent
Locke et al.

(10) Patent No.: US 10,446,003 B2
(45) Date of Patent: Oct. 15, 2019

(54) SYSTEM AND METHODS FOR MONITORING AND ENTRAPMENT PREVENTION FOR A PERSON DISPOSED IN A BED

(71) Applicant: Huntleigh Technology Limited, Bedfordshire (GB)

(72) Inventors: Christopher Locke, Bournemouth (GB); David Whyte, Wareham (GB); Aidan Tout, Alberbury (GB)

(73) Assignee: Huntleigh Technology Limited (GB)

( * ) Notice: Subject to any disclaimer, the term of this patent is extended or adjusted under 35 U.S.C. 154(b) by 3 days.

(21) Appl. No.: 14/055,418

(22) Filed: Oct. 16, 2013

(65) Prior Publication Data

US 2014/0104404 A1 Apr. 17, 2014

Related U.S. Application Data

(60) Provisional application No. 61/714,615, filed on Oct. 16, 2012.

(51) Int. Cl.
*G08B 21/02* (2006.01)

(52) U.S. Cl.
CPC ..... *G08B 21/02* (2013.01)

(58) Field of Classification Search
None
See application file for complete search history.

(56) References Cited

U.S. PATENT DOCUMENTS

| | | | | |
|---|---|---|---|---|
| 4,633,237 | A | 12/1986 | Tucknott et al. | 340/573.4 |
| 7,378,975 | B1 * | 5/2008 | Smith | A61B 5/1126 340/573.1 |
| 7,821,415 | B1 | 10/2010 | Kimberlin | 340/666 |
| 2007/0132597 | A1 * | 6/2007 | Rodgers | A61B 5/1113 340/573.1 |
| 2008/0195776 | A1 * | 8/2008 | Jensen | H04L 12/40006 710/61 |
| 2011/0087079 | A1 | 4/2011 | Aarts | 600/300 |
| 2011/0205062 | A1 * | 8/2011 | Pesot | A61B 5/0006 340/573.1 |
| 2012/0075464 | A1 * | 3/2012 | Derenne | A61B 5/0013 348/135 |
| 2013/0246088 | A1 * | 9/2013 | Huster | G06Q 10/0635 705/2 |
| 2014/0039351 | A1 * | 2/2014 | Mix | A61B 5/1114 600/587 |

FOREIGN PATENT DOCUMENTS

WO WO-2011154873 A1 * 12/2011 ..... G06F 3/011

* cited by examiner

*Primary Examiner* — William C Vaughn, Jr.
*Assistant Examiner* — Stuart D Bennett
(74) *Attorney, Agent, or Firm* — The Webb Law Firm

(57) ABSTRACT

Methods, systems, and devices for monitoring a patient, monitoring and/or controlling an adjustable bed and/or preventing patient entrapment. The system may include one or more sensors operatively associated with a processor for performing said monitoring and other functions. The processor may be operatively associated with an adjustable patient bed to interrupt user adjustment of the bed and/or control a patient support.

12 Claims, 6 Drawing Sheets

SYSTEM AND METHODS FOR MONITORING AND ENTRAPMENT PREVENTION FOR A PERSON DISPOSED IN A BED

CROSS-REFERENCE TO RELATED APPLICATIONS

This application claims priority to U.S. Provisional Application No. 61/714,615 filed Oct. 16, 2012, the entire contents of which is incorporated herein by reference.

FIELD OF THE INVENTION

The present invention relates generally to beds and support surfaces (e.g., used to support patients in a hospital), and, more particularly, but not by way of limitation, to systems and methods for monitoring patient position and/or preventing patient entrapment.

BACKGROUND

One example of a cause of injury and death in acute health care settings is entrapment in bed side rails, such as those of hospital beds. While several designs have been proposed to reduce patient entrapment, the need to have a foldable and adjustable rail at the side of a bed remains in conflict with the need to reduce the risk of entanglement of patient limbs and medical equipment (e.g., pacing wires, ventilator hoses and catheter tubes).

Alarm and monitoring systems may be used in some cases to alert caregivers to movement of at-risk patients, and/or patients may be physically restrained (e.g., especially when there is a ratio of less than one caregiver per patient and it is not physically possible for the patient to be attended to and observed at all times).

U.S. Pat. No. 7,821,415 discloses a "pneumatic patient bed monitor" that uses a pressure monitoring interface underneath the patient to sense the removal of patient weight. Other systems are also designed to sense patient contact or weight using pneumatic or electrical sensors. For example, U.S. Pat. No. 4,633,237 includes "a plurality of sensors defining interstices of a matrix of such sensors."

U.S. patent application Ser. No. 12/996,034 (published as Pub. No. US 2011/0087079) discloses acoustical patient monitoring using a sound classifier and microphone.

SUMMARY

The present disclosure includes embodiments of non-contact systems and methods for patient monitoring that utilize visualization and motion tracking methodologies to create a stand-alone or integrated system which can alert the caregiver to dangerous positioning or movement of a patient, and/or act as a secondary safety system to prohibit the potentially dangerous adjustment of bed components (e.g., back incline). Some embodiments of the present systems can be configured to monitor a patient's movements to detect signs of convulsion or seizure, and/or to detect the position of patient interfaces such as catheter insertion points, respiratory assistance connections, and/or monitoring connections (e.g., prevent and/or reduce the likelihood of inadvertent entrapment of such interfaces). Some embodiments of the present systems and methods can be configured to provide non-contact detection that is less susceptible to mechanical failure or accidental activation as mechanical switches and others sensing means, and/or to avoid excessive wiring and electronics integration over the area of a bed frame or the use of a local communications network such as KAN.

Methods, systems (e.g., computer systems), and other devices and apparatuses (such as non-transitory computer readable media) are disclosed for monitoring adjustable beds. The present systems can be configured to prevent and/or reduce the likelihood of: persons, clothing, and/or medical equipment being entrapped in adjustable beds (e.g., side rails and/or other pinch points), such as, for example, as or when the beds or bed components are adjusted.

Some embodiments of the present methods of monitoring an adjustable bed comprise: defining, in a computer memory, a first boundary of a first region that includes at least a portion of an adjustable bed; receiving, with a processor, video information indicative of at least a portion of the first region; monitoring, with the processor, the first boundary in the video information; and interrupting adjustability of the bed if an object is disposed across the first boundary or within the first region. Some embodiments further comprise: generating an audio indication. In some embodiments, the video information comprises depth information. In some embodiments, the processor receives the video information from at least one sensor device. In some embodiments, the at least one sensor device is disposed at the footboard of the bed. In some embodiments, the video information is transmitted wirelessly from at least one sensor device. In some embodiments, the sensor device is capable of tracking objects. In some embodiments, a graphical user interface displays at least a portion of the video information. In some embodiments, the boundary is defined by a user (is user-defined). In some embodiments, the object is at least one of a body part, medical equipment, or an article of clothing. In some embodiments, interrupting adjustability is ceased when at least one of: the object is no longer disposed across the first boundary or within the first region; and when an override command is received at the processor. In some embodiments, the bed is a hospital bed, and the first region includes at least a portion of the hospital bed.

Some embodiments of the present systems for monitoring an adjustable bed comprise: a computer processor in communication with a memory storing information indicative of a first boundary of a first region that includes at least a portion of an adjustable bed; the computer processor being configured to: receive video information indicative of at least a portion of the first region; monitor the first boundary in the video information; and interrupt adjustability of the bed if an object is disposed across the first boundary or within the first region. In some embodiments, the video information comprises video and depth information. In some embodiments, the processor is configured to receive video information from at least one sensor device.

Some embodiments of the present systems further comprise: at least one sensor device. In some embodiments, the at least one sensor device is at least one of configured to be coupled to the bed or incorporated into the footboard of the bed. In some embodiments, the at least one sensor device is configured to wirelessly transmit the video information. In some embodiments, the sensor device is capable of tracking objects. In some embodiments, the processor is configured to communicate with a graphical user interface. In some embodiments, the processor is configured to display at least a portion of the video information on a graphical user interface. In some embodiments, the information indicative the boundary is information defined using the graphical user interface. In some embodiments, the processor is configured to receive the information indicative of the first boundary of the first region from a user input device. Some embodiments further comprise: a user input and a display; where the computer processor is configured to receive signals from the user input device to define a path over at least a portion of the video information depicted on the display, and store the path as the information indicative of a first boundary of a first region. In some embodiments, the object is at least one of a body part, medical equipment, or an article of clothing. In some embodiments, the processor is further configured to cease interrupting adjustability when at least one of: the object is no longer disposed across the first boundary or within the first region; or an override command is received at the processor. In some embodiments, the bed is a hospital bed, and the first region includes at least a portion of the hospital bed.

Some embodiments of the present systems further comprise: an adjustable bed comprising controls for adjusting the bed; an interrupt device configured to interrupt adjustability of the bed; and where the sensor device is configured to generate the video information indicative of at least a portion of the first region; and where the first region includes at least a portion of the bed. In some embodiments, the sensor device is incorporated into the footboard of the bed. In some embodiments, the processor is configured to receive the information indicative of the first boundary of the first region from a user input device. Some embodiments further comprise: a user input device; where the computer processor is configured to receive signals from the user input device to define a path over at least a portion of the video information depicted on the display, and store the path as the information indicative of a first boundary of a first region. In some embodiments, the processor is further configured to cease sending the signal to the interrupt device when at least one of: the object is no longer disposed across the first boundary or within the first region; and when an override command is received at the processor.

Some embodiments of the present methods of monitoring an adjustable bed comprise: receiving, with a processor, video information indicative of at least a portion of the bed and of at least a portion of a person occupying the bed; monitoring, with the processor, the spatial position of body parts of the person occupying the bed; and sending a signal in response to at least the spatial position of a body part of the person. In some embodiments, the video information comprises video and depth information. In some embodiments, the video information comprises body part tracking information. In some embodiments, the signal is sent in response to the changes in position of the body part of the person. In some embodiments, the signal is sent in response to changes indicating physical distress. In some embodiments, the signal is sent in response to changes indicating that the person has slid toward the foot of the bed. In some embodiments, the signal is an adjustability interruption signal and the signal is sent in response to the person's arm being in proximity to bed adjustment controls. In some embodiments, the signal is an alarm signal and the alarm signal is sent to a networked monitoring station.

Any embodiment of any of the present methods, systems, and devices can consist of or consist essentially of—rather than comprise/include/contain/have—any of the described elements and/or features. Thus, in any of the claims, the term "consisting of" or "consisting essentially of" can be substituted for any of the open-ended linking verbs recited above, in order to change the scope of a given claim from what it would otherwise be using the open-ended linking verb.

Details associated with the embodiments described above and others are presented below.

BRIEF DESCRIPTION OF THE DRAWINGS

The following drawings illustrate by way of example and not limitation. For the sake of brevity and clarity, every feature of a given structure is not always labeled in every figure in which that structure appears. Identical reference numbers do not necessarily indicate an identical structure. Rather, the same reference number may be used to indicate a similar feature or a feature with similar functionality, as may non-identical reference numbers.

DETAILED DESCRIPTION OF THE INVENTION

The term "coupled" is defined as connected, although not necessarily directly, and not necessarily mechanically; two items that are "coupled" may be unitary with each other. The terms "a" and "an" are defined as one or more unless this disclosure explicitly requires otherwise. The term "substantially" is defined as largely but not necessarily wholly what is specified (and includes what is specified; e.g., substantially 90 degrees includes 90 degrees and substantially parallel includes parallel), as understood by a person of ordinary skill in the art. In any disclosed embodiment, the terms "substantially," "approximately," and "about" may be substituted with "within [a percentage] of" what is specified, where the percentage includes 0.1, 1, 5, and 10 percent.

The terms "comprise" (and any form of comprise, such as "comprises" and "comprising"), "have" (and any form of have, such as "has" and "having"), "include" (and any form of include, such as "includes" and "including") and "contain" (and any form of contain, such as "contains" and "containing") are open-ended linking verbs. As a result, a system or apparatus that "comprises," "has," "includes" or "contains" one or more elements possesses those one or more elements, but is not limited to possessing only those elements. Likewise, a method that "comprises," "has," "includes" or "contains" one or more steps possesses those one or more steps, but is not limited to possessing only those one or more steps.

The terms region, area, volume, space and the like are used herein interchangeably and mean, unless specifically stated otherwise, any three-dimensional collection of points.

Further, a structure (e.g., a component of an apparatus) that is configured in a certain way is configured in at least that way, but it can also be configured in other ways than those specifically described.

Unless specifically stated otherwise, as apparent from the following discussion, it is appreciated that throughout this specification discussions utilizing terms such as "processing," "computing," "calculating," "determining" or the like, refer to actions or processes of a computing platform, such as a computer or a similar electronic computing device, that manipulates or transforms data represented as physical electronic or magnetic quantities within memories, registers, or other information storage devices, transmission devices, or display devices of the computing platform.

Figure 1:
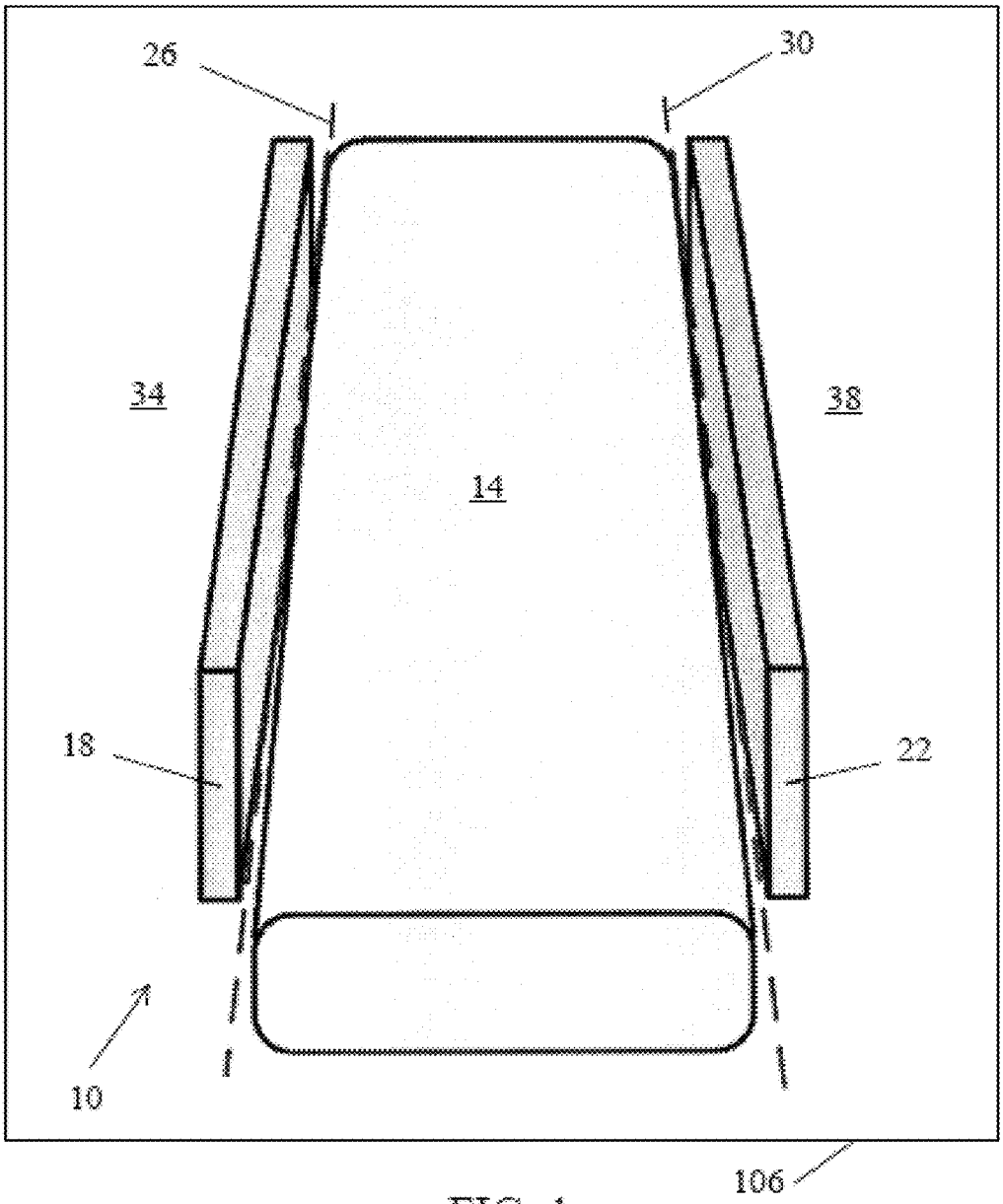
FIG. 1 shows a block diagram of an adjustable bed that may be used in and/or with some embodiments of the present invention.

Referring now to the drawings, and more particularly to FIG. 1, shown there is a block diagram of an embodiment 10 of an adjustable bed that may be used in and/or with some embodiments of the present systems and methods. In the embodiment shown, adjustable bed 10 includes a mattress 14, a first or right side rail 18, and a second or left side rail 22. A first or right side-rail boundary 26 is depicted by a dashed line lying along the edge of mattress 14 nearest the right side-rail. A second or left side-rail boundary 30 is depicted by a dashed line lying along the edge of the edge of mattress 14 nearest the left side rail. Left and right side-rail boundaries 26 and 30 are shown as examples to illustrate one embodiment of the present systems and methods. Additional and/or alternative boundaries (e.g., foot-end and/or head-end edges of mattress 14) may also be defined in relation to an adjustable bed. Boundaries 26 and 30 are depicted as dashed lines in three-dimensional space and represent, for purposes of illustration, portions of two vertical planes intersecting the dashed lines. In various ones of the present embodiments, boundaries may be three-dimensional surfaces (e.g., planar or curved surfaces), collections of points defining vertices of a three-dimensional space, and/or three-dimensional spaces defined by combinations of surfaces and vertices. Combinations of any these different types of boundaries may be used simultaneously.

In this embodiment, boundaries 26 and 30 define keep-out regions 34 and 38, respectively, on the right side of boundary 26 and left side of boundary 30. Keep-out region 34 includes a portion of bed 10 that includes right side-rail 18, and keep-out region 38 includes a portion of bed 10 that includes left side-rail 22. A keep-out region is a region in space that includes at least one area in which certain objects should not be located (e.g., may be at risk of being pinched or entangled) while the bed is being adjusted, such as to prevent such an object from becoming entangled in a side rail during adjustment. Keep-out regions need not be limited only to regions including the side-rails of an adjustable bed. For example, a keep-out region may include any portion of a bed (e.g., regions that include areas near the borders of the mattress, the top edge of the mattress, the bottom edge of the mattress, and/or areas above or below the adjustable bed).

Bed 10, for example, may be equipped with one or more sets of controls that allow the patient and/or hospital staff to adjust the bed. The controls may elevate or lower mattress 14, raise or lower the head or foot of the mattress, fold the mattress into a seat, inflate the mattress, deflate the mattress, and/or raise, lower, or fold one or both of side-rails 18 and 22. Many combinations of the aforementioned adjustments as well as additional adjustments may be included in the bed. For example, certain adjustable beds are specifically designed for the treatment of certain medical conditions and may be capable of complex adjustments particular to that condition.

Certain adjustments may present a danger if they are conducted while a patient is improperly positioned on the bed. For example, raising the head or foot of a mattress may pinch and/or otherwise injure a patient if the patient's limb is extended through or directly adjacent to a bed side rail. As another example, a patient or bystander's fingers may be pinched if they are located near a hinge or pinch-point of the bed when the bed is adjusted to articulate or fold the mattress (e.g., into a chair-like configuration). A bed with dual (e.g., head-end and foot-end) side-rails on each of the left and right sides of the bed may injure body parts that are between the two side-rails when the bed is adjusted (e.g., by raising the back section to elevate the head of a patient). Similarly, certain adjustments may present a danger to other objects if they are improperly positioned during adjustment of the bed. For example, medical equipment (e.g., patient connections) may be crushed, pinched, stretched, bent or otherwise damaged when parts of the bed are moved. Likewise, clothing and other textiles may become entangled or torn when parts of the bed are moved.

Figure 2:
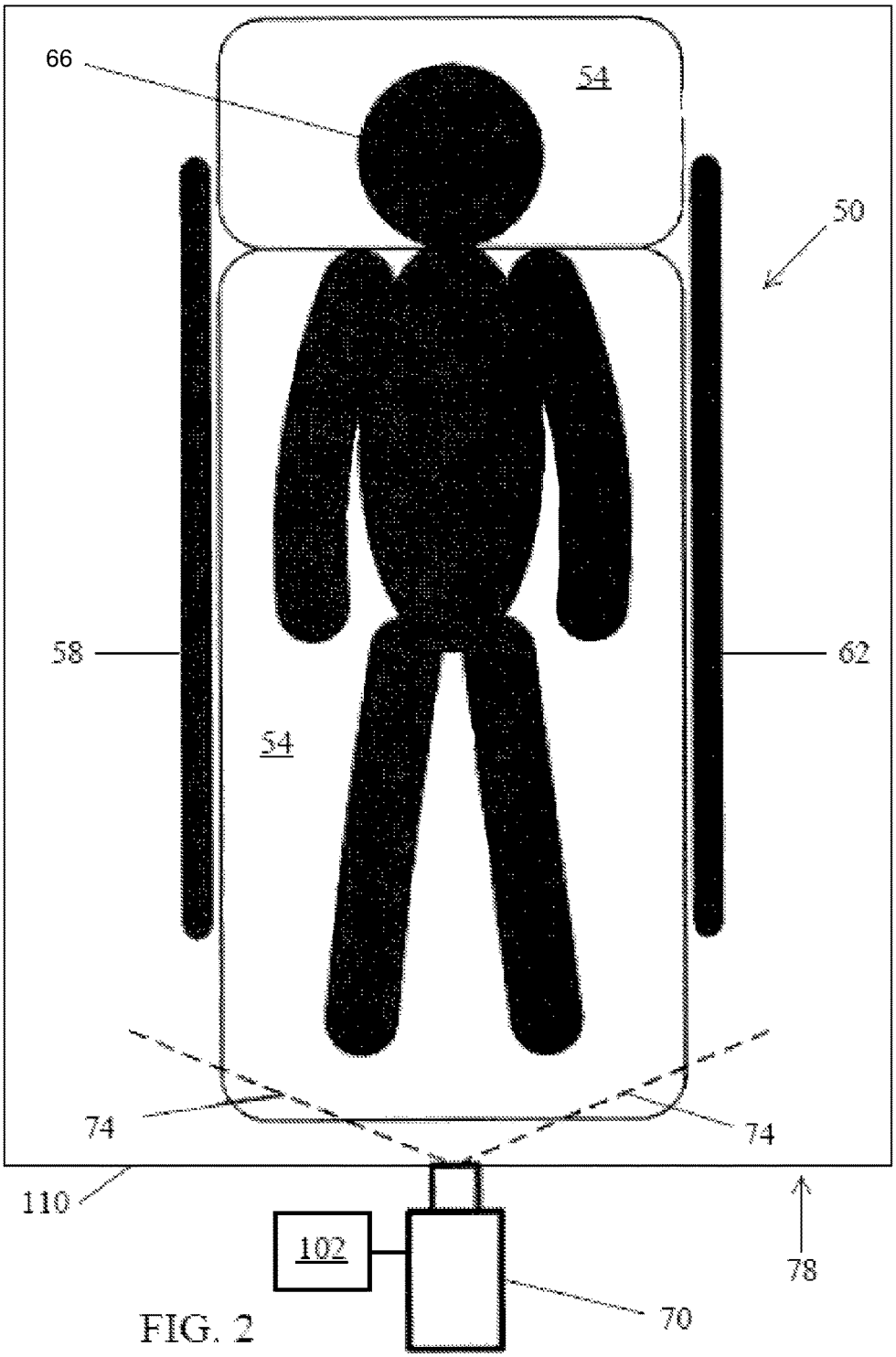
FIG. 2 shows a depiction of one embodiment of an adjustable bed and sensor with a patient lying between the side-rails of the bed.
Figure 3:
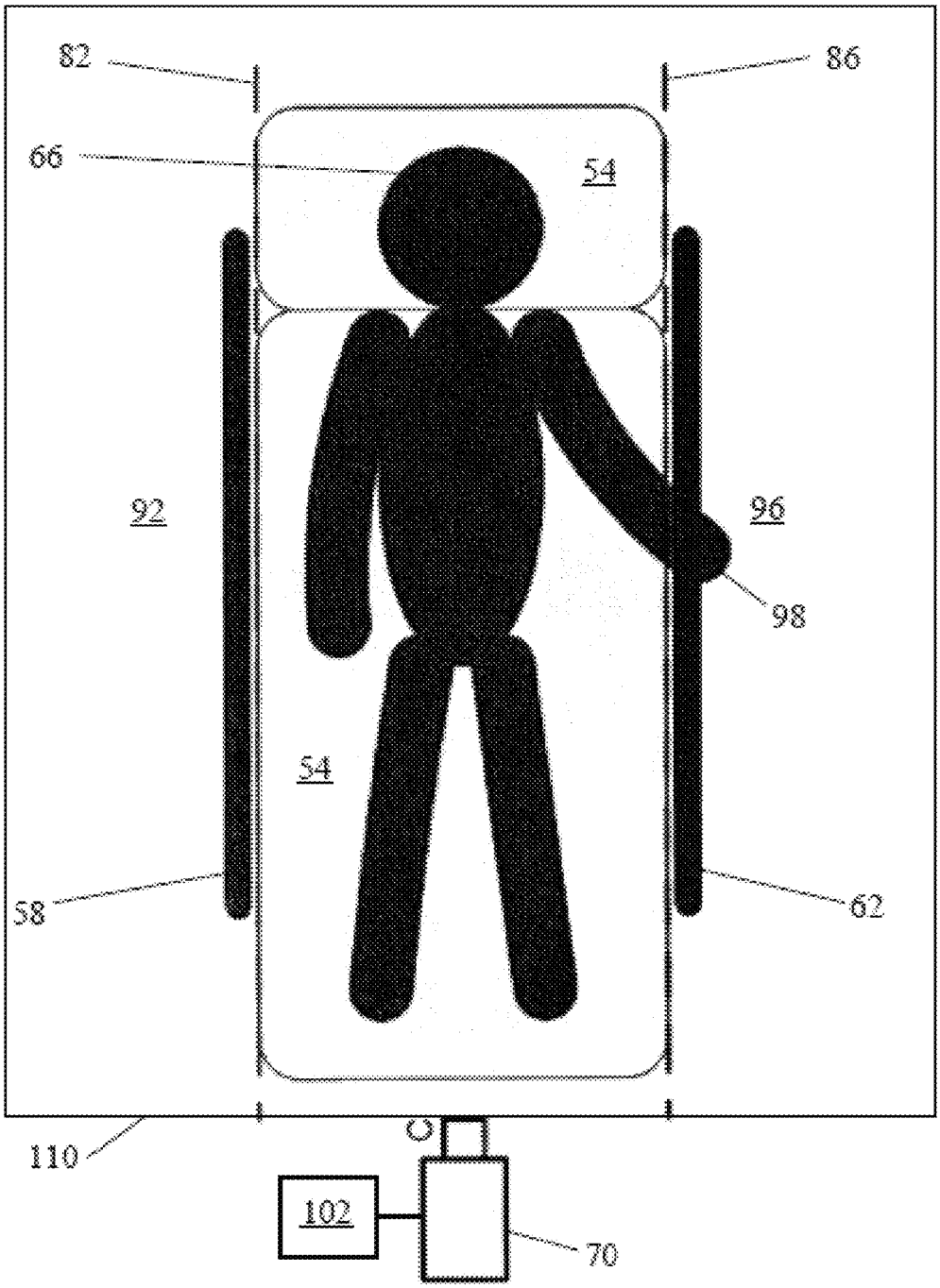
FIG. 3 shows a depiction of the same bed and sensor with a patient that is lying with a body part disposed within the area of the left side-rail of the bed.

FIGS. 2 and 3 depict a second embodiment of the present systems in combination with an adjustable bed 50 having a two-part mattress 54, and right and left side-rails 58 and 62. A patient 66 is shown lying on mattress 54 between side-rails 58 and 62. In the embodiment shown, the system comprises a sensor device 70 that is configured to generate video information is located so that it may generate video information indicative of (e.g., depicting) at least a portion of the defined keep-out region(s). Sensor device 70 is positioned and/or otherwise configured to have a field of view 74 (depicted by dashed lines indicating a three-dimensional cone-like shape forward of the sensor) within which the sensor can generate video information of the bed and/or patient. In practice, sensor 70 may have a field of view that is variable and/or not perfectly cone-shaped. For example, the field of view may be wider horizontally than vertically, and/or or may extend farther to the right or left. The field of view also has a depth 78. In some embodiments, sensor 70 can comprise a Microsoft Kinect® sensor.

Boundaries 82 and 86 (shown as dashed lines and representative of vertical planes passing through those dashed lines) at the left and right edges of mattress 54 define keep-out regions 90 and 94, respectively. Keep-out region 90 includes a portion of bed 50 that includes right side-rail 58. Keep-out region 94 includes a portion of bed 50 that includes left side-rail 62. As such, if a patient 34 has a limb 98 (e.g., a hand) in contact with left side rail 62 as shown in FIG. 3, that limb will necessarily cross boundary 86 into keep-out area 94. In this embodiment, sensor device 70 is configured to generate video information indicative of keep-out the region including bed 50, boundaries 82 and 86, and/or regions 92 and 96. For example, in some embodiments, sensor device 70 comprises a video camera configured to obtain video images of at least some of each of bed 50, boundaries 82 and 86, and regions 92 and 96. In other embodiments, sensor device 70 can be configured to obtain video information indicative of only keep-out areas 92 and 96 (e.g., sensor device 70 can comprise dual video detectors or cameras, or can comprise a single video detector or camera with a portion of its field of view is blocked, such as the portion in which mattress 54 is disposed). In some embodiments, sensor device 70 can comprises a video detector or camera that is configured to detect light in the infrared range and/or can otherwise be configured to not capture features of a patient from which the patient could be identified (e.g., can capture the outline of the patient without enough resolution or clarity to be able to visually identify the patient in the captured video information).

In some embodiments, sensor device 70 can comprise a video camera, webcam, or other similar video capture device. The information generated by the sensor device 35 may include picture information that is displayable on a user display (e.g., television, computer screen), and/or may include depth information indicative of the distance from the sensor device of various objects and/or positions in the video information. For example, sensor device 70 can comprise a motion-sensing input device such as a Microsoft Kinect®. The Kinect device is capable of generating video information as well as depth information corresponding to the field depth 78 of objects in the field of view 74. Additionally, the Kinect device can generate video information comprising multiple useful data streams and includes a software development kit (SDK) allowing advanced interaction with, and monitoring of the video information that is generated. A programming guide detailing the Kinect for Windows SDK has been made available by Microsoft (an index of links to various sections is available, for example, at http://msdn-.microsoft.com/en-us/library/hh855347.aspx) and is incorporated herein by reference in its entirety. Such a device can include, for example, one or more video cameras, one or more additional sensors to detect depth (e.g., one additional sensor with an output that can be used with the output(s) of the one or more video cameras to detect depth, or two additional sensors with two additional outputs that can be used together to detect depth). Depth information can be determined or approximated, for example, by comparing the position of certain features in video information obtained by two or more sensors that are spaced apart from one another, and algebraically solving for the distance from the two or more sensors based on the geometric properties of the relative positions of the sensors. Such a device can also include one or more microphones, such as, for example, an array of multiple (e.g., directional) microphones.

In some embodiments, the sensor device may generate video information that includes object tracking information, body part tracking information (e.g., skeletal or limb tracking information, joint tracking information joint orientation information, and/or face tracking information). For example, in some embodiments, identifiers that are configured to emit light or other output, or that are otherwise distinguishable in video information, can be coupled to hands and feet (and/or other parts) of a patient such that the position(s) of the identifier(s) are identifiable in video information indicative of a patient on the bed. In some embodiments of the present systems can comprise plurality of sensor devices that can be used in simultaneous and/or alternating fashion.

In the embodiment shown, a controller 102 (e.g., a computer comprising a computer processor and memory) is coupled to sensor device 70 such that controller 102 can receive video information from sensor device 70. Controller 102 can be coupled to sensor device 70 by, for example, a cable or other wiring, wirelessly, in packets via TCP/IP or other network protocols; and/or through intermediary devices such as routers or other devices. Controller 102 can be configured to monitor boundaries 82 and 86 and/or keep-out regions 92 and 96 to detect whether the patient, other persons, and/or objects have crossed boundaries 82 and 86 and/or are disposed in keep-out regions 92 and 96. Controller 102 can be coupled to bed 50 (e.g., to an adjustment mechanism and/or control circuit of the bed) and configured to interrupt adjustability of the bed if an object is disposed across a boundaries 82 or 86 and/or within a keep-out region 92 and/or 86 (e.g., with a certain distance of a boundary, such as, for example, within 12 inches of boundary 82 or 86). For example, if an adjustment of the bed is underway when controller 102 detects an object crossing a boundary or within a keep-out region, controller 102 can be configured to send a signal to interrupt an adjustment mechanism and/or control circuit of the bed to stop the adjustment. Likewise, if an adjustment is not underway when controller 102 detects an object crossing a boundary and/or within a keep-out region, the controller can be configured to send a signal to interrupt an adjustment mechanism and/or control circuit of the bed to prevent an adjustment from being started while the object is crossing the boundary and/or disposed within a keep-out region.

In some embodiments, keep-out regions (e.g., 92, 96) may extend from a boundary to the limit of the field of view of the sensor device. In other embodiments, keep out regions may be defined to extend only a particular distance from each boundary (e.g., 6, 12, 18, 24 or more inches from a boundary). Thus, in the embodiment shown, keep out regions may extend from boundaries horizontally to the limit of the sensor device's field of view. In other embodiments, the keep-out regions may be limited so that they extend only a particular distance from the boundaries. As one example, the keep-out regions may be defined to extend 12-inches horizontally from the boundaries 82 and 86 such that the rails 58 and 62 are within the keep-out regions but are more than 12 inches horizontally outward of boundaries 82 and 86 are not within the keep-out regions. Keep-out regions may also be defined as the space between two or more boundaries, the space between a boundary or boundaries and the limit of the sensor's field of view, or as the space encompassed by one closed boundary. Keep-out regions may be defined in any shape or orientation and need not have edges that are parallel to parts of the bed or to the walls or ceiling of the room in which the bed may be located. Similarly, keep-out regions may be defined so as to extend in any direction or directions from boundaries.

In some embodiments, controller 102 can be configured monitor skeletal or limb tracking information, joint tracking information, joint orientation information, and/or face tracking information, such as may be embedded within the video information as described above. For example, a processor within the controller can be configured to execute instructions from memory within the controller to identify and track certain body parts (e.g., faces, arms, legs) within video information (e.g., with or without identifiers coupled to the patient, as mentioned above). In some embodiments, the processor may use object tracking information including skeletal and/or joint tracking information to distinguish body parts such as limbs or joints from other objects such as medical equipment or clothing. In other embodiments adjustability may be interrupted depending upon the type of object disposed across a boundary or within a keep-out region. For example, if a patient's limb is disposed across a boundary and/or within a keep-out region, adjustability of the bed may be interrupted; but if a catheter or other small object is disposed across a boundary and/or within a keep-out region, adjustability of the bed may not be interrupted. In such embodiments, adjustability of the bed may be interrupted with respect to some adjustments but not others. As one example, if an object is determined to be disposed across a boundary that is adjacent to the head of the bed, adjustments to the head of the bed may be interrupted while adjustments of the foot of the bed are not interrupted. In further examples (e.g., in embodiments using a sensor device such as a Microsoft Kinect®) various body parts, limbs, and other objects can be distinguished to vary the interruption of bed adjustability according to various body parts, limbs, or other objects. For example, adjustability may be interrupted when an elbow has entered a keep-out region but not when a hand has entered the same keep-out region (e.g., to permit a user's hand to access adjustment controls that may be disposed on a side rail).

In some embodiments, controller 102 can include and/or can be coupled to a display (e.g., television, computer screen) and/or to a user input device (e.g., a keyboard, a mouse). Such a display can be display at least a portion of the field of view of sensor device 70. For example, in FIG. 1 the perimeter of a display is illustrated by box 106; and in FIGS. 3 and 4, the perimeter of a display is illustrated by box 110. As will be appreciated from the depicted views, in the view of FIG. 1, sensor device 70 is disposed above the foot end of the bed; and in the view of FIGS. 2 and 3, sensor device 70 is disposed directly above the bed (e.g., coupled to a ceiling). In such embodiments, controller 102 can comprise instructions for showing via a coupled display (e.g., a remote computer display) a graphical user interface (GUI) that can include part (e.g., all) of the video information or images from the sensor device. In such a GUI, the user can define boundaries (e.g., 82, 86) and/or keep-out regions (e.g., 92, 96) that the system can use as to trigger interruption of bed adjustability. For example, in some embodiments, a user can simply position a cursor at a point on the display (e.g., in the displayed video or picture information) at which a boundary is desired and "click" a mouse key or depress a keyboard key to select each of one or more such points to define the desired boundaries and/or keep-out regions.

In some embodiments, controller is configured to provide an alert for a caregiver if boundary has been crossed and/or a patient limb or other object is disposed in a keep-out region, and to permit a user to override the interruption of adjustability and thereby permit adjustment of the bed despite the detected incursion. A log of system alerts may, for example, be recorded in internal memory of controller 102 such that it can be interrogated or reviewed (e.g., in the event of an incident).

In some embodiments, controller 102 may be configured to correlate controls or patient-inputs (e.g., buttons) of the bed (e.g., identified by one or more user input signals via GUI, such as, for example, at the time that boundaries or keep-out regions are defined) within the video information and/or to define a range of alert areas within which controller may reference the location of the patient. For example, in some embodiments, controller 102 (e.g., an embedded system) may be configured to prohibit activation of some or all of the bed controls if the control button being activated is in the vicinity of a portion (e.g., a hand) of the patient laying in the bed, such that patient activation of the controls of the bed can be limited or prohibited. Similarly, controller 102 can be configured to recognize when a patient's hand is in the vicinity of controls being activated such that adjustment may be permitted even though that hand is also within a keep-out region.

The ability of the sensor system coupled with an appropriate embedded system to recognize gestures and movements can have numerous other applications in the acute care environment especially as caregiver time is spread more widely and direct patient monitoring is often reduced. For example, embodiments of the present systems (e.g., controller 102) can be configured to monitor a patient for signs of distress such as convulsions caused by choking, pain, seizure, and/or a cardiac episode. Additionally, some embodiments can be configured to recognize circumstances indicating the onset of stroke (e.g., if one side of a patient's body (e.g., suddenly) moves in a very different way to the other side of the patient's body).

As another example, it may be desirable to turn or reposition a bed-born patient (e.g., every 2 hours or more frequently) such as to prevent tissue breakdown. Some of the present embodiments can be configured to monitor a patient to detect when the patient has moved or been repositioned, to monitor the time since the last time the patient moved or was repositioned, to notify nursing staff of the need to turn or reposition a patient, and/or notifying nursing staff that turning or repositioning can be postponed (e.g., if the patient has turned or moved on their own). Movement monitoring data may also be used in conjunction with an alternating pressure surface with turning ability to determine if greater motion should be provided to compliment a patient's natural or monitored level of motion. For example, some embodiments of controller 102 can communicate with or be integrated into a control unit for a turning mattress to increase or decrease turning functions performed by an inflatable patient support (e.g., mattress and/or turning bladders) to ensure an appropriate magnitude and/or frequency of movement for a patient.

Some embodiments of the present systems can be configured to assist healthcare providers in identifying circumstances sometimes associated with ventilator-associated pneumonia. For example, healthcare providers often position a patient in a head-up position as a preventative measure for reducing the likelihood of a patient developing ventilator-associated pneumonia. In some embodiments, the present systems can be configured to monitor a patient for longitudinal motion toward the foot-end of the bed, and thereby detect (e.g., and sound an alarm or otherwise alert healthcare professionals) if the patient slides down toward the foot end of the bed such that the elevation of the patient's head is decreased.

As noted above, some embodiments of the present systems can be configured to monitor the locations of patient connections such as catheters, tubes, leads, and/or the like. For example, such patient connections can be configured to assist their identification in the video information, such as, for example, by way of coloring (e.g., red, blue, green) reflective components, and/or other characteristics or identifiers that improve the ability of the controller to distinguish the patient connections in the video information and thereby monitor the locations of the patient connections to reduce the likelihood of them becoming entangled in the bed frame (e.g., and being pinched and/or pulled away from a patient during adjustment of a bed). By way of further example, markers or identifiers placed on or otherwise coupled to tubes, tube connections or catheter locations can enhance the ability of the system to detect position and/or kinking of the tubes. Controller 102 can be configured to include various combinations of the foregoing functions and/or other functions. For example, controller 102 can be configured to monitor the video information to detect the presence of a patient and/or to alert caregivers if a patient has been absent from the bed for a predetermined period of time (e.g., 5 minutes, 10 minutes, or 0 minutes if the system is set, such as via the GUI, to alert caregivers to any patient absence). In some embodiments, controller 102 can be configured to detect and identify small repetitive motions or vibrations such as those of a shivering or seizing patient, and/or to sound an alarm or otherwise alert caregivers that a patient may be cold or seizing. Controller 102 can further be configured to log video information and/or detected conditions or patient characteristics to assist caregivers in evaluating the patient.

Some embodiments of the present systems are configured to communicate with a remote station (e.g., a computer at a nurses station) such that the controller can transmit data and/or alarm signals to the remote station. For example, controller 102 (e.g., a modem or wireless transceiver in or coupled to the controller) can be coupled to the remote bait station via a wired (e.g., telephone) connection and/or a wireless (e.g., Wi-Fi) connection. In such embodiments, multiple systems can be coupled to the remote station such that a plurality of patients can be monitored at the remote station. In other embodiments, controller 102 can receive instructions via the GUI that is displayed at the remote station.

Figure 4:
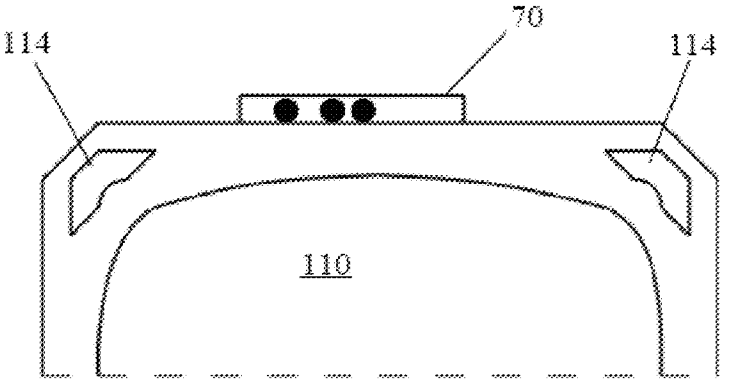
FIG. 4 shows a depiction of the footboard of an adjustable bed with a sensor device.

Referring now to FIG. 4, a sensor device suitable for use in and/or with embodiments of the present systems is shown implemented as an integral part of the embedded architecture of an adjustable bed frame. Sensor device 70 can be located such that its field of view includes boundary or boundaries and/or keep-out region(s) that are to be monitored. In some embodiments the sensor device is mounted in, or on the footboard of the adjustable bed. In some embodiments, the sensor may be mounted on the headboard of the adjustable bed, on a riser post, on or within the ceiling or wall of the room housing the bed, or suspended over the bed. Likewise, the field of view of the sensor device need not be directed horizontally and may be directed downward, or at any angle so long as its field of view allows it to generate video information indicative of the keep-out regions. Depicted is a footboard portion 114 of an adjustable bed and a sensor 70 of the present systems integrated into the footboard. Footboard 114 is shown from the point of view of a person lying in the adjustable bed. Sensor device 70 in this embodiment is a Microsoft Kinect® device. The sensor device is mounted on the footboard of the adjustable bed. In this embodiment, footboard 114 has voids 118 in it that create handles for use in moving the bed. In some embodiments of the present invention, the sensor device may be attached to the bed. Attachment may be by any of various structures, such as, for example, screws, mounting brackets, Velcro, adhesive, acrylic foam tape, welds, straps, clips, pins, permanent attachments, removable attachments, and/or the like. Temporary, or removable attachments may assist in situations where the system of this invention is desired to be portable or where it is useful to be able to move the sensor from one bed to another or from a bed of one design to a bed of another design. Preferably, the placement of the sensor does not interfere with use of any handles 114 that may be built into the footboard of the bed. In other embodiments, sensor device 70 may be incorporated into the footboard of the bed itself. In some embodiments holes may be fashioned in the footboard so that lenses and other sensors have access through the footboard. Transparent panels may also be incorporated to allow sensors to work through the footboard.

Figure 5:
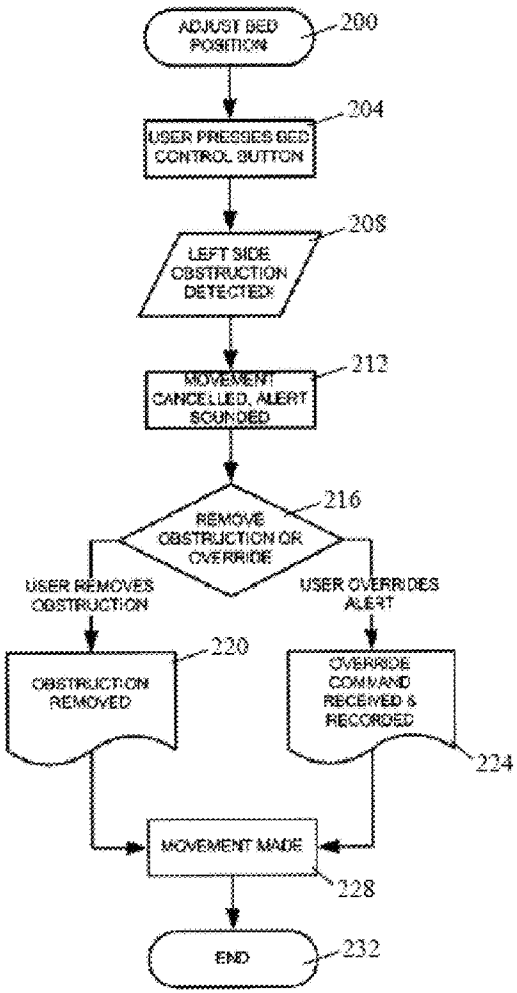
FIG. 5 provides a flow chart for performing aspects of the present methods.

FIG. 5 depicts a flow chart for performing examples of aspects of at least some embodiments of the present methods. In the embodiment sown, adjusting 200 the position of an adjustable bed proceeds with a user pressing (e.g., patient or caregiver) 204 a bed control (e.g., button). In the depicted process, a computer processor (e.g., in controller 102) receiving and monitoring video information detects at 208 an obstruction on the left side of the bed. As described above, the detection of an obstruction can occur when the processor determines that an object (e.g., body part) is disposed across a boundary or within a keep-out region. In this example, the object is disposed across a boundary or within a region on the left side of the bed. The processor sends a signal to stop 212 the movement or adjustment (adjustability of the bed is interrupted), and an alarm may be sounded and/or caregivers otherwise alerted. Adjustability remains interrupted until 216 when either the obstruction is removed at 220 or a user overrides the alert at 224 by sending an override command to the processor (e.g., and the override is logged). The user is then permitted to complete 228 the adjustment or movement and the adjusting ends at 232.

In some embodiments of the present systems, the controller (e.g. a processor within controller 102) may be configured to monitor the boundary or boundaries and/or keep-out region(s) continuously and interrupt adjustability whenever an object obstructs a boundary or keep-out region. In other embodiments, the controller may be configured to monitor the boundary or boundaries and/or keep-out regions only while the bed controls are being operated, or when the controls are accessed. Some embodiments may use combinations of these monitoring schemes.

Interrupting adjustability may be achieved in any of numerous ways. In some embodiments, the processor may interrupt adjustability by sending a signal to the bed indicating that adjustments should not be permitted. In some embodiments, the processor may be configured to maintain and update at intervals an interruption register in computer memory. In some embodiments, the bed controls may be configured to query the state of the interruption register before adjustment is permitted and during the course of adjustment. In other embodiments, an existing adjustable bed may be retrofitted with a device for interrupting adjustability. These interruption schemes are provided as illustrative examples rather than limitations. Additional schemes for preventing adjustment or interrupting adjustment are also available. In some embodiments, an interrupt device may be in communication with the computer processor and function to interrupt adjustability of the bed when an interrupt signal is received. For example, an addressable switch can be retrofit into a power circuit for actuators and/or a control circuit of an adjustment system of the bed such that controller 102 can send a signal to the switch to interrupt adjustability of the bed.

Figure 6A:
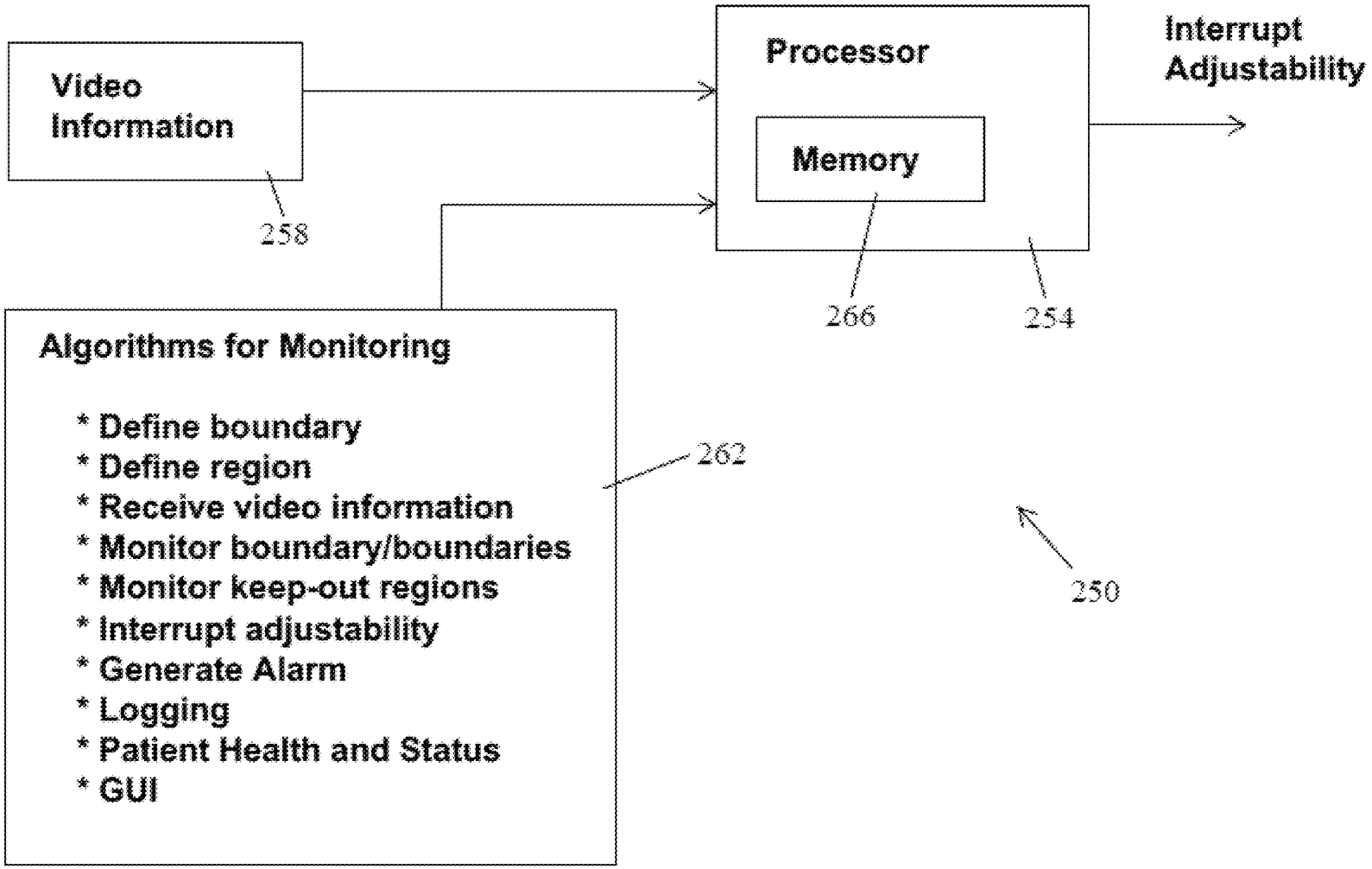
FIG. 6A is a block diagram of one embodiment of a computer system configured to monitor an adjustable bed.

FIG. 6A depicts a block diagram of one embodiment of a computer system 250 that can monitor an adjustable bed consistent with at least one embodiment of the present methods. A processor 254 (or multiple processors) is configured (e.g., through hardwiring, software, or a combination of both) to perform one of the present methods using video information 258 and an embodiment of the algorithms discussed in this disclosure, for which executable instructions may be included a code module 262. Video information 258 is obtained from one or more sensor devices. A memory 266 may be a part of the processor (or multiple processors) or it may be a separate module or modules. The memory contains boundary and keep-out region definitions. Processor (or processors) 254 is a special-purpose processor, and computer system 250 of which processor 254 is a part is a special-purpose computer system, because they cannot be controlled to perform these functions when purchased off-the-shelf; and, instead, must be programmed or otherwise configured (e.g., with software programming and/or hardwiring) in order to perform these functions. The use of a processor 250 allows for the processing and consideration of large amounts of video information 254 that is not possible without the aid of a computer, a computer system, or a processor. The use of a processor 250 may also allow for the real-time processing, or near real time processing of the video information and interruption of adjustability. Any one or more of the steps of the various embodiments of the present methods may be performed (or, in the case of the present computer systems or devices, the system or device may be configured to perform any one or more of the steps or functions discussed above), such as, for example, within a certain amount of time, including no more than one hour, no more than 30 minutes, no more than 15 minutes, no more than 10 minutes, no more than one minute, no more than one second, and no more than 100 msec.

Some embodiments of the present methods include converting into digital electrical signals data that is received via a machine such as a keyboard, a touch screen, a wand, a point and click device (e.g., a mouse), or another suitable input device, so that the signals can then be processed in order to carry out other steps in the respective method. The conversion may be accomplished by an input device (such as through a processor in a keyboard) or through the processor or processors that accomplish other steps of the method. The source of a given piece of information may include a local or remote database that may be accessible by the processor. In some embodiments, remote databases may be accessible through a computer network, such as the internet. Some embodiments of the present computer systems may include a machine capable (either through software control or hard wiring) of accomplishing this data conversion.

Figure 6B:
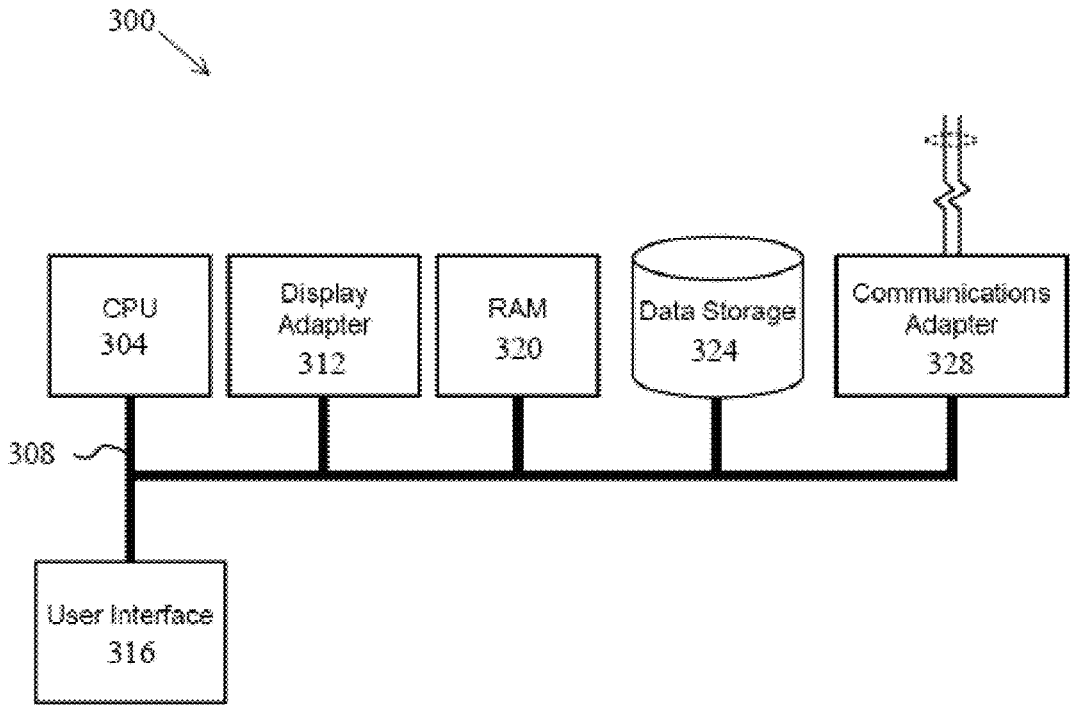
FIG. 6B shows an embodiment of a computer system that may be used to perform embodiments of the present methods.

FIG. 6B depicts an embodiment of a computer system that may be used to perform embodiments of the present methods. Computer system 300 includes a central processing unit, or CPU 304, that is capable of executing computer instructions. CPU 304 is coupled to a bus 308 that carries information between different modules or components within computer system 300. Display adapter 312 is also connected to the bus 308 and is capable of displaying graphics. For example, the display adapter may be capable of outputting video information to a display 316. RAM 320 is also connected to bus 308. RAM is used by CPU 304 to execute instructions. Data Storage 324 is connected to bus 308 and is capable of storing digital data. Digital data may include instruction code that is executed by CPU 304. Display 316 is also connected to bus 308 and allows a user to interact with the computer system 300. One example of a user interface is a keyboard (not shown). Finally, communications adapter 328 is connected to bus 308. The communications adapter may be a network card that allows computer system 300 to connect to the internet. The communications adapter may comprise a specialized adapter for receiving video information. The communications adapter may also comprise specialized adapters for interrupting adjustability or for communicating with an adjustability interruption device or software. In some embodiments, CPU 304 may be a device that executes software instructions. In addition, CPU 304 may be hard-wired to perform the functions of the disclosed methods. For example, CPU 304 may be an Application Specific Integrated Circuit (ASIC) that is configured to execute the functions of the disclosed methods without the use of external software.

In some of the present embodiments, at least a portion of the video information is displayed on a display 316. The display may be a touch screen interface, a mobile device interface, an application within an operating system, and/or a dedicated hardware interface with a display screen. Display 316 may display the video portion of the video information and/or may display still images from the video information.

In embodiments in which the boundary/boundaries and/or keep-out regions are depicted on the graphical user interface, the boundaries and/or keep-out regions may be depicted by, for example, using techniques such as transparent overlay, shading, outlines, or three dimensional representations. In some embodiments the boundaries and keep out regions are predefined in computer memory. In some embodiments sets of alternative boundaries and keep-out regions are predefined in memory allowing a user to choose optimal boundaries and keep-out regions for a particular patient, condition or set of equipment. In some embodiments, combinations of different pre-defined boundaries and keep-out regions may be selected. In some embodiments keep-out regions pertaining to a number of different bed models or configurations are pre-defined in memory. In some embodiments, boundaries may be defined using the graphical user interface. In one embodiment, video information comprising live video is displayed on a user's mobile device. Using the touch screen on the mobile device user defines a boundaries by drawing paths on the screen with a finger or stylus. The path on the screen may be represented by a semitransparent overlay atop the video or with a solid color. A path drawn on the screen may be considered a single line defining a boundary. Alternatively, the entire width of the finger or stylus drawing the path may be used to define a keep-out region as wide as the path covered by the finger or stylus with boundaries enclosing it.

Other methods of defining boundaries and regions are contemplated within the scope of the present invention. In some embodiments a pointer icon may be used along with an input device such as a mouse to define boundaries and keep-out regions. Various graphical user interface elements for drawing may also be used. For example, pencil icons may be used to draw paths representing boundaries while varying width paintbrush icons may be used to draw paths defining keep-out regions surrounded by boundaries.

In some embodiments boundaries and regions may be defined textually, or rather, mathematically using a two, or three-dimensional coordinate system. In some embodiments, the processor may be configured to use video information including depth information to provide three-dimensional location information pertaining to reference points on the adjustable bed. Such bed location information may be provided textually and/or or visually such as, for example, by displaying coordinate information corresponding to reference points of the adjustable bed on the graphical user interface. In some embodiments, this location information may assist a user in textually defining boundaries and regions. In other embodiments the processor may be configured to generate boundaries and regions appropriate for a particular bed model based on the bed location information.

In further embodiments, textually and/or mathematically defined boundaries and regions may be graphically represented on the graphical user interface such as, for example, with transparent overlays or solid colors. In some embodiments, the boundaries and/or keep-out regions may be represented on the graphical user interface as projections of three dimensional shapes.

In some embodiments, the controller is configured to extend into three dimensions boundaries and regions defined using two-dimensional paths (e.g., by a user via an embodiment of the present GUIs). In other embodiments, the graphical user interface is configured to permit a user to explicitly define three-dimensional boundaries and regions. In some embodiments, the controller is configured to graphically represent depth with color gradients, such as, for example, by overlaying over the video information colors corresponding to the depth of objects in the video information. A legend indicating the entire range depths and corresponding colors may also be displayed in the GUI, and/or the GUI may support definition of boundaries and regions in three dimensions by permitting users to define for individual paths drawn a corresponding color gradient range (e.g., to convert paths drawn in two dimensions into boundaries or regions having depth).

The methods of defining boundaries and/or regions using the graphical user interface are presented by way of example only and are not intended to be limiting. Additional schemes for defining three dimensional representations using a graphical user interface may be utilized.

The above specification and examples provide a complete description of the structure and use of exemplary embodiments. Although certain embodiments have been described above with a certain degree of particularity, or with reference to one or more individual embodiments, those skilled in the art could make numerous alterations to the disclosed embodiments without departing from the scope of this invention. As such, the various illustrative embodiments of the present devices are not intended to be limited to the particular forms disclosed. Rather, they include all modifications and alternatives falling within the scope of the claims, and embodiments other than the one shown may include some or all of the features of the depicted embodiment. Further, where appropriate, aspects of any of the examples described above may be combined with aspects of any of the other examples described to form further examples having comparable or different properties and addressing the same or different problems. Similarly, it will be understood that the benefits and advantages described above may relate to one embodiment or may relate to several embodiments.

The claims are not intended to include, and should not be interpreted to include, means-plus-or step-plus-function limitations, unless such a limitation is explicitly recited in a given claim using the phrase(s) "means for" or "step for," respectively.

The invention claimed is:

1. A method of monitoring an adjustable bed comprising:

defining, in a computer memory, a first boundary of a first region that includes at least a portion of an adjustable bed located in the first region;

receiving, with a processor, video information indicative of at least a portion of only the first region without receiving video information indicative of a second region that includes at least another portion of the adjustable bed located in the second region, wherein the at least another portion of the adjustable bed includes a mattress;

monitoring, with the processor, the first boundary in the video information;

distinguishing, with the processor, a body part from medical equipment and/or clothing in the video information;

distinguishing, with the processor, a first type of body part of the body part from a second type of body part different than the first type of body part in the video information;

determining, with the processor, that the first type of body part of the body part is disposed across the first boundary or within the first region;

preventing or interrupting, with the processor, adjustability of the bed in response to determining the first type of body part of the body part is disposed across the first boundary or within the first region.

2. The method of claim 1, where the method further comprises: generating an audio indication.

3. The method of claim 1, where the video information comprises depth information.

4. The method of claim 1, where the processor receives the video information from at least one sensor device.

5. The method of claim 4, where the at least one sensor device is disposed at the footboard of the bed.

6. The method of claim 4, where the video information is transmitted wirelessly from at least one sensor device.

7. The method of claim 4, where the sensor device is capable of tracking objects.

8. The method of claim 1, where a graphical user interface displays at least a portion of the video information.

9. The method of claim 8, where the first boundary is defined by a user in the at least a portion of the video information displayed by the graphical user interface.

10. The method of claim 1, where interrupting adjustability is ceased when at least one of: the first body part is no longer disposed across the first boundary or within the first region; and when an override command is received at the processor.

11. A method of monitoring an adjustable bed comprising:

defining, in a computer memory, a first boundary of a first region that includes at least a portion of an adjustable bed at a first edge of a mattress and a second boundary of a second region that includes at least a portion of the adjustable bed at a second edge of the mattress opposite the first edge of the mattress, wherein the first region includes a first side-rail of the adjustable bed, wherein the second region includes a second side-rail of the adjustable bed, and wherein the mattress is located between the first side-rail of the adjustable bed and the second side-rail of the adjustable bed outside of the first region and the second region;

obtaining, with a single video camera, images of only the first region and the second region, wherein a portion of a field of view of the single video camera that includes a third region including the mattress between the first boundary and the second boundary is permanently and completely blocked;

monitoring, with the processor, at least one of the first boundary and the second boundary based on the images;

determining, with the processor, that a body part is disposed across the at least one of the first boundary and the second boundary; and preventing or interrupting, by the processor, adjustability of the bed in response to determining the body part is disposed across the at least one of the first boundary and the second boundary.

12. A system for monitoring an adjustable bed comprising:

a single video camera configured to obtain images, wherein a portion of a field of view of the single video camera that includes a mattress of the adjustable bed is permanently and completely blocked; and one or more processors programmed or configured to:

define a first boundary of a first region that includes at least a portion of the adjustable bed at a first edge of the mattress;

define a second boundary of a second region that includes at least a portion of the adjustable bed at a second edge of the mattress opposite the first edge of the mattress, wherein the first region includes a first side-rail of the adjustable bed, wherein the second region includes a second side-rail of the adjustable bed, and wherein the mattress is located between the first side-rail of the adjustable bed and the second side-rail of the adjustable bed outside of the first region and the second region;

obtain images of only the first region and the second region from the single video camera, wherein the portion of the field of view of the single video camera including the mattress of the adjustable bed that is permanently and completely blocked includes a third region between the first boundary and the second boundary;

monitor at least one of the first boundary and the second boundary based on the images;

determine that a body part is disposed across the at least one of the first boundary and the second boundary; and prevent or interrupt adjustability of the bed in response to determining the body part is disposed across the at least one of the first boundary and the second boundary.

* * * * *